US009524845B2

(12) United States Patent
Boye et al.

(10) Patent No.: US 9,524,845 B2
(45) Date of Patent: Dec. 20, 2016

(54) X-RAY TUBE CATHODE WITH MAGNETIC ELECTRON BEAM STEERING

(75) Inventors: James Russell Boye, Salt Lake City, UT (US); Robert Clark Treseder, North Salt Lake, UT (US)

(73) Assignee: VARIAN MEDICAL SYSTEMS, INC., Palo Alto, CA (US)

( * ) Notice: Subject to any disclaimer, the term of this patent is extended or adjusted under 35 U.S.C. 154(b) by 507 days.

(21) Appl. No.: 13/352,641

(22) Filed: Jan. 18, 2012

(65) Prior Publication Data

US 2013/0182825 A1 Jul. 18, 2013

(51) Int. Cl.

| | |
|---|---|
| ***H01J 35/06*** | (2006.01) |
| ***H01J 35/14*** | (2006.01) |
| ***H01J 35/30*** | (2006.01) |

(52) U.S. Cl.

CPC ..... *H01J 35/06* (2013.01); *H01J 35/14* (2013.01); *H01J 35/30* (2013.01); *H01J 2235/06* (2013.01)

(58) Field of Classification Search

CPC ..... H01J 2235/06; H01J 35/06; H01J 35/14; H01J 35/30

USPC ..... 378/136, 137, 138

See application file for complete search history.

(56) References Cited

U.S. PATENT DOCUMENTS

| | | | |
|---|---|---|---|
| 3,250,916 | A | 5/1966 | Rogers |
| 3,783,333 | A | 1/1974 | Atlee |
| 3,875,028 | A | 4/1975 | Atlee et al. |
| 3,916,202 | A | 10/1975 | Heiting et al. |
| 3,962,583 | A | 6/1976 | Holland et al. |
| 4,064,352 | A | 12/1977 | Mann |
| RE30,082 | E | 8/1979 | Atlee et al. |
| 4,373,144 | A | 2/1983 | Franke |
| 4,631,744 | A | 12/1986 | Haberrecker |
| 4,689,809 | A | 8/1987 | Sohval |
| 4,764,947 | A | 8/1988 | Lesensky |
| 4,819,260 | A | 4/1989 | Haberrecker |
| 5,125,019 | A | 6/1992 | Evain et al. |
| 5,222,114 | A | 6/1993 | Kamata et al. |
| 5,224,143 | A | 6/1993 | Dumitrescu et al. |
| 5,313,510 | A | 5/1994 | Ebersberger et al. |
| 5,422,527 | A | 6/1995 | Lazzaro |

(Continued)

FOREIGN PATENT DOCUMENTS

| | | | |
|---|---|---|---|
| JP | H11111204 | A | 4/1999 |
| JP | 2009158138 | A | 7/2009 |

OTHER PUBLICATIONS

International Search report and Written Opinion mailed Apr. 30, 2013 in related PCT Application No. PCT/US2013/021775.

*Primary Examiner* — Glen Kao

(74) *Attorney, Agent, or Firm* — Maschoff Brennan

(57) ABSTRACT

An x-ray tube cathode with magnetic electron beam steering. In one example embodiment, an x-ray tube cathode includes a cathode head and an electron emitter. The cathode head includes electrically conductive and non-magnetic material integrated with magnetic material. The cathode head defines an emitter slot in a portion of electrically conductive and non-magnetic material positioned between two portions of magnetic material. The electron emitter is positioned within the emitter slot. The electron emitter is configured to emit a beam of electrons. The beam of electrons is configured to be both focused by the electrically conductive and non-magnetic material and steered during beam formation by the magnetic material.

20 Claims, 5 Drawing Sheets

(56) References Cited

U.S. PATENT DOCUMENTS

| | | | | |
|---|---|---|---|---|
| 5,541,975 | A | 7/1996 | Anderson et al. | |
| 5,548,630 | A | 8/1996 | Hell et al. | |
| 5,550,889 | A | 8/1996 | Gard et al. | |
| 5,689,542 | A | 11/1997 | Layering et al. | |
| 5,812,632 | A | 9/1998 | Schardt et al. | |
| 5,898,755 | A | 4/1999 | Meusel et al. | |
| 6,055,294 | A | 4/2000 | Foerst et al. | |
| 6,091,799 | A * | 7/2000 | Schmidt | H01J 35/30 378/113 |
| 6,111,934 | A | 8/2000 | Foerst et al. | |
| 6,115,454 | A | 9/2000 | Andrews et al. | |
| 6,128,367 | A | 10/2000 | Foerst et al. | |
| 6,151,384 | A * | 11/2000 | Reed et al. | 378/138 |
| 6,181,771 | B1 * | 1/2001 | Hell et al. | 378/137 |
| 6,252,935 | B1 | 6/2001 | Styrnol et al. | |
| 6,292,538 | B1 | 9/2001 | Hell et al. | |
| 6,339,635 | B1 | 1/2002 | Schardt et al. | |
| 6,438,207 | B1 | 8/2002 | Chidester et al. | |
| 6,529,579 | B1 | 3/2003 | Richardson | |
| 6,968,039 | B2 | 11/2005 | Lemaitre et al. | |
| 7,257,194 | B2 | 8/2007 | Smith | |
| 2003/0053595 | A1 * | 3/2003 | Taguchi et al. | 378/136 |
| 2005/0157846 | A1 * | 7/2005 | Neumeier et al. | 378/137 |
| 2005/0175152 | A1 * | 8/2005 | Smith | 378/136 |
| 2006/0050850 | A1 | 3/2006 | Andrews et al. | |
| 2007/0183576 | A1 * | 8/2007 | Burke et al. | 378/136 |
| 2010/0195799 | A1 * | 8/2010 | Tomita et al. | 378/138 |
| 2010/0278308 | A1 | 11/2010 | Shimono | |
| 2010/0284519 | A1 * | 11/2010 | Moore et al. | 378/136 |
| 2010/0322383 | A1 | 12/2010 | Coon et al. | |

* cited by examiner

X-RAY TUBE CATHODE WITH MAGNETIC ELECTRON BEAM STEERING

BACKGROUND

X-ray tubes are extremely valuable tools that are used in a wide variety of applications, both industrial and medical. An x-ray tube typically produces x-rays in an omnidirectional fashion where the useful portion ultimately exits the x-ray tube through a window in the x-ray tube, and interacts with a subject, such as a material sample or a patient, in order to create an x-ray image.

During the operation of some x-ray tubes, the x-ray tube is translated or rotated about a subject in order to produce x-ray images of the subject at various angles. Unfortunately, however, the motion of the x-ray tube can result in an effective increase of the focal spot size. This effective increase in the focal spot size, also known as motion blurring of the focal spot, can result in reduced resolution of the imaging of the subject.

The subject matter claimed herein is not limited to embodiments that solve any disadvantages or that operate only in environments such as those described above. Rather, this background is only provided to illustrate one exemplary technology area where some embodiments described herein may be practiced.

BRIEF SUMMARY OF SOME EXAMPLE EMBODIMENTS

In general, example embodiments relate to an x-ray tube cathode with magnetic electron beam steering. The example cathode disclosed herein is configured to create and steer a beam of electrons during beam formation. This steering can, in at least some example embodiments, enable an x-ray tube to translate or rotate on a gantry about a subject while the beam of electrons is steered so that a mean position of a focal spot of the beam of electrons remains stationary in the subject's frame of reference despite the motion of the x-ray tube, resulting in consistent imaging of the subject.

In one example embodiment, an x-ray tube cathode includes a cathode head and an electron emitter. The cathode head includes electrically conductive and non-magnetic material integrated with magnetic material. The cathode head defines an emitter slot in a portion of electrically conductive and non-magnetic material positioned between two portions of magnetic material. The electron emitter is positioned within the emitter slot. The electron emitter is configured to emit a beam of electrons. The beam of electrons is configured to be both focused by the electrically conductive and non-magnetic material and steered during beam formation by the magnetic material.

In another example embodiment, an x-ray tube cathode includes a magnetic yoke, a cathode head, and an electron emitter. The magnetic yoke includes a core and a coil. The core has a base and two ends formed from a magnetic material. The coil is wound around the base of the core. The two ends are configured to function as magnetic poles when an electric current is passed through the coil. The cathode head includes electrically conductive and non-magnetic material integrated with the two ends. The cathode head defines an emitter slot positioned between the two ends. The electron emitter is positioned within the emitter slot. The electron emitter is configured to emit a beam of electrons. The beam of electrons is configured to be both focused by the electrically conductive and non-magnetic material and steered during beam formation by the magnetic poles.

In yet another example embodiment, an x-ray tube includes an evacuated enclosure, an anode positioned within the evacuated enclosure, and a cathode. The cathode includes a magnetic yoke, a cathode head, and an electron emitter. The magnetic yoke includes a core and a coil. The core has a base and two ends formed from a magnetic material. The coil is wound around the base of the core. The coil and the base are positioned outside the evacuated enclosure. The two ends are positioned within the evacuated enclosure. The two ends are configured to function as magnetic poles when an electric current is passed through the coil. The cathode head includes electrically conductive and non-magnetic material integrated with the two ends. The cathode head defines an emitter slot in the electrically conductive and non-magnetic material positioned between the two ends. The electron emitter is positioned within the emitter slot and is configured to emit a beam of electrons. The electron emitter is immersed in a uniform magnetic field created by the magnetic yoke that is configured to steer the beam of electrons during beam formation These and other aspects of example embodiments of the invention will become more fully apparent from the following description and appended claims.

BRIEF DESCRIPTION OF THE DRAWINGS

To further clarify certain aspects of the present invention, a more particular description of the invention will be rendered by reference to example embodiments thereof which are disclosed in the appended drawings. It is appreciated that these drawings depict only example embodiments of the invention and are therefore not to be considered limiting of its scope. Aspects of example embodiments of the invention will be described and explained with additional specificity and detail through the use of the accompanying drawings in which.

DETAILED DESCRIPTION OF SOME EXAMPLE EMBODIMENTS

Example embodiments of the present invention relate to an x-ray tube cathode with magnetic electron beam steering. Reference will now be made to the drawings to describe various aspects of example embodiments of the invention. It is to be understood that the drawings are diagrammatic and schematic representations of such example embodiments, and are not limiting of the present invention, nor are they necessarily drawn to scale.

1. Example X-Ray Tube

Figure 1A:
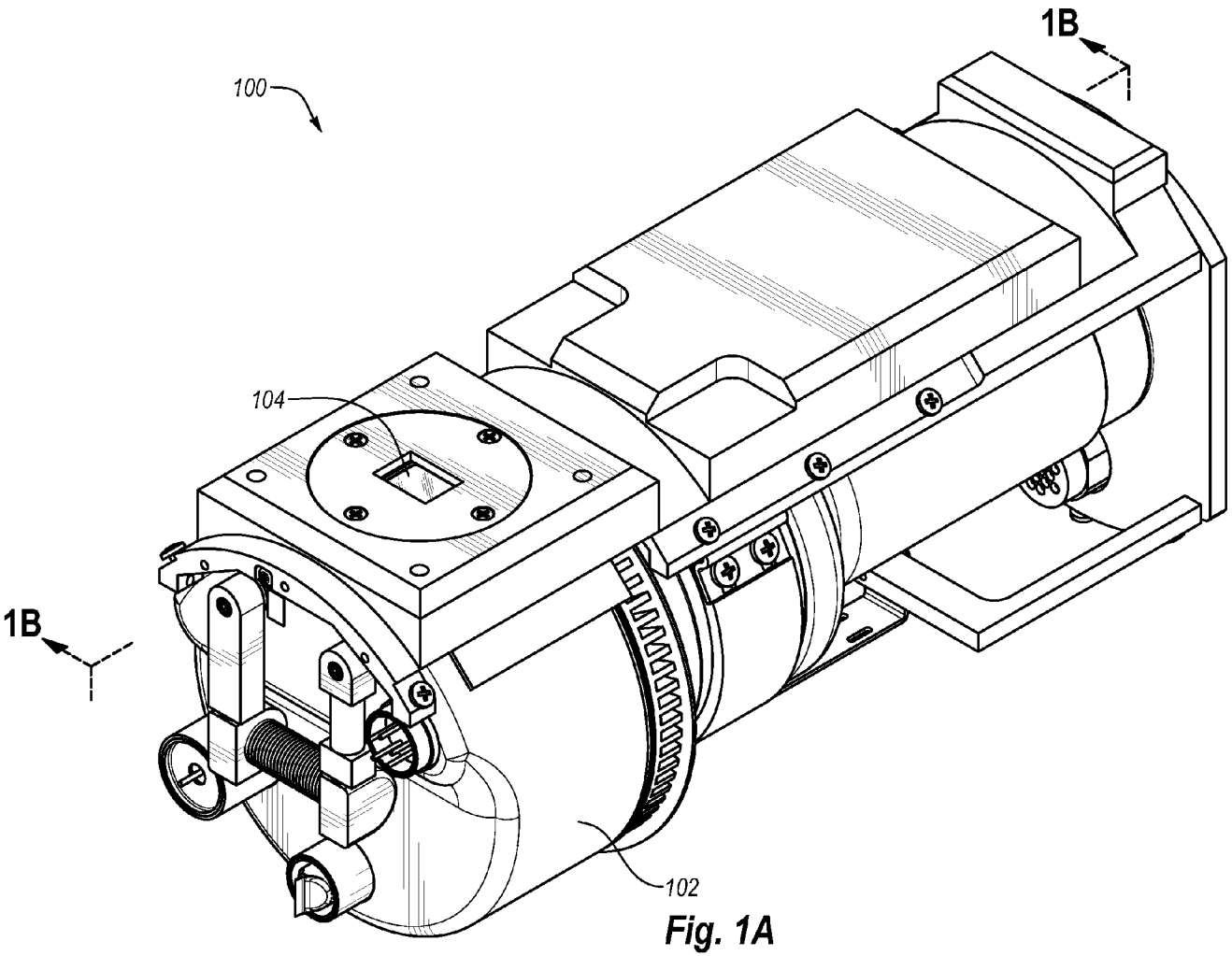
FIG. 1A is a perspective view of an example x-ray tube.
Figure 1B:
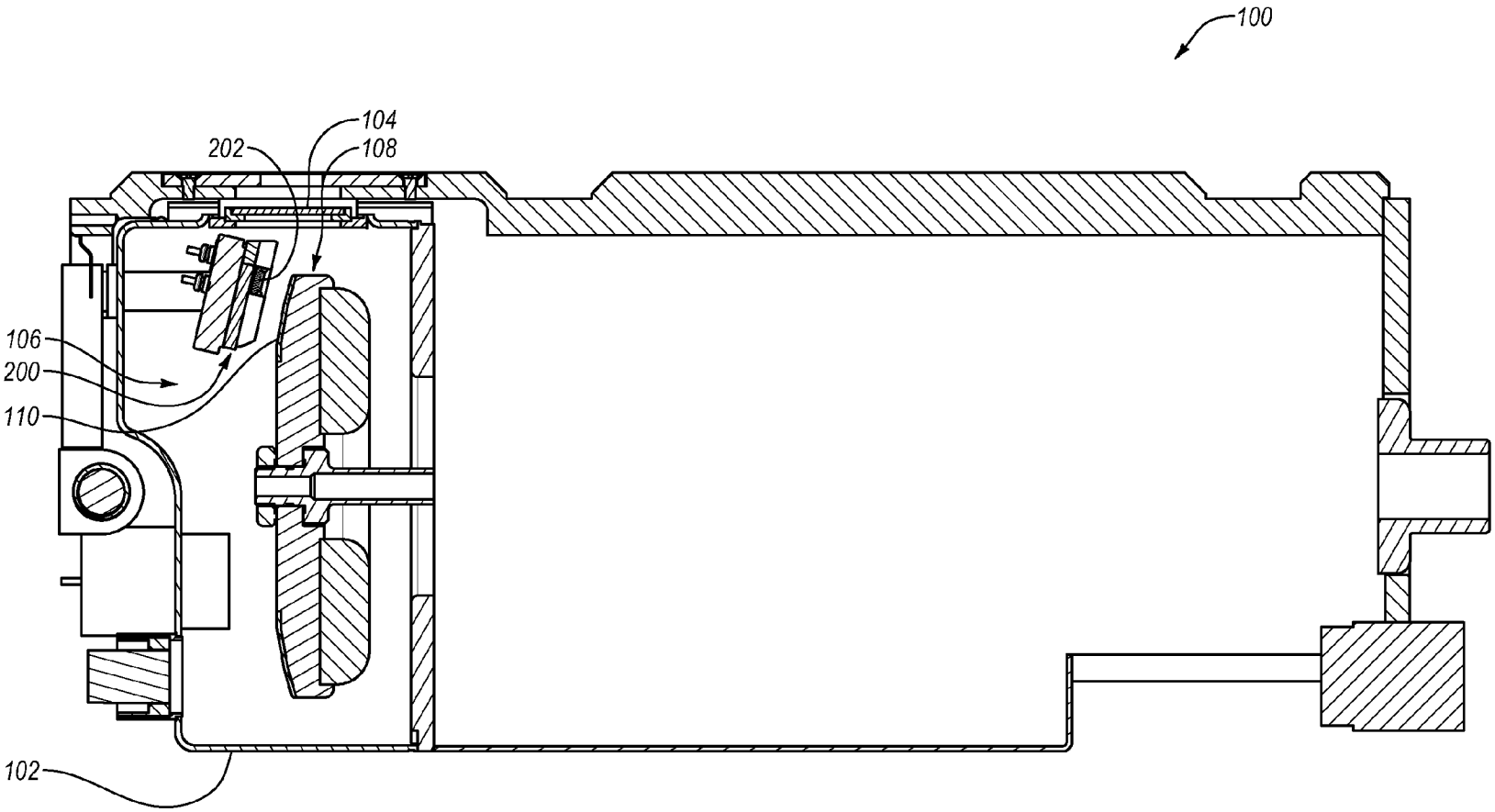
FIG. 1B is a cross-sectional side view of the example x-ray tube of FIG. 1A.

With reference first to FIGS. 1A and 1B, a first example dual-energy x-ray tube 100 is disclosed. As disclosed in FIG. 1A, the example x-ray tube 100 generally includes a can 102 and an x-ray tube window 104 attached to the can 102. The x-ray tube window 104 is comprised of an x-ray transmissive material, such as beryllium or other suitable material(s). The can 102 may be formed from stainless steel, such as 304 stainless steel.

As disclosed in FIG. 1B, the x-ray tube window 104 and the can 102 at least partially define an evacuated enclosure 106 within which an anode 108 and a cathode 200 are positioned. More particularly, the cathode 200 extends into the can 102 and the anode 108 is also positioned within the can 102. The anode 108 is spaced apart from and oppositely disposed to the cathode 200. The anode 108 and the cathode 200 are connected in an electrical circuit that allows for the application of a high voltage potential between the anode 108 and the cathode 200.

With continued reference to FIG. 1B, prior to operation of the example x-ray tube 100, the evacuated enclosure 106 is evacuated to create a vacuum. Then, during operation of the example x-ray tube 100, an electrical current is passed through an electron emitter 202 of the cathode 200 to cause a beam of electrons to be emitted from the cathode 200 by thermionic emission. For example, the cathode may be configured to operate between about 25 kV and about 50 kV, such as about 31 kV for example. The application of a high voltage differential between the anode 108 and the cathode 200 then causes the beam of electrons to accelerate from the cathode 200 and toward a rotating focal track 110 that is positioned on the rotating anode 108. The focal track 110 may be composed for example of tungsten or other material (s) having a high atomic ("high Z") number. As the electrons accelerate, they gain a substantial amount of kinetic energy, and upon striking the target material on the rotating focal track 110, some of this kinetic energy is converted into x-rays.

The focal track 110 is oriented so that many of the emitted x-rays are collimated by the x-ray tube window 104. As the x-ray tube window 104 is comprised of an x-ray transmissive material, the x-rays emitted from the focal track 110 pass through the x-ray tube window 104 in order to be attenuated in a subject, such as a material sample or a patient (not shown), and then imaged on an image detector (not shown) in order to produce an x-ray image (not shown). The window 104 therefore hermetically seals the vacuum of the evacuated enclosure 106 of the x-ray tube 100 from the atmospheric air pressure outside the x-ray tube 100 and yet enables the x-rays generated by the rotating anode 108 to exit the x-ray tube 100.

Although the example x-ray tube 100 is depicted as a rotatable anode x-ray tube, example embodiments disclosed herein may be employed in other types of x-ray tubes. Thus, the example electron emitters disclosed herein may alternatively be employed, for example, in a stationary anode x-ray tube. Further, although the electron emitter 202 is disclosed as a helical filament, it is understood that the electron emitter 202 may instead be a flat filament.

2. Example Cathode

Figure 2:
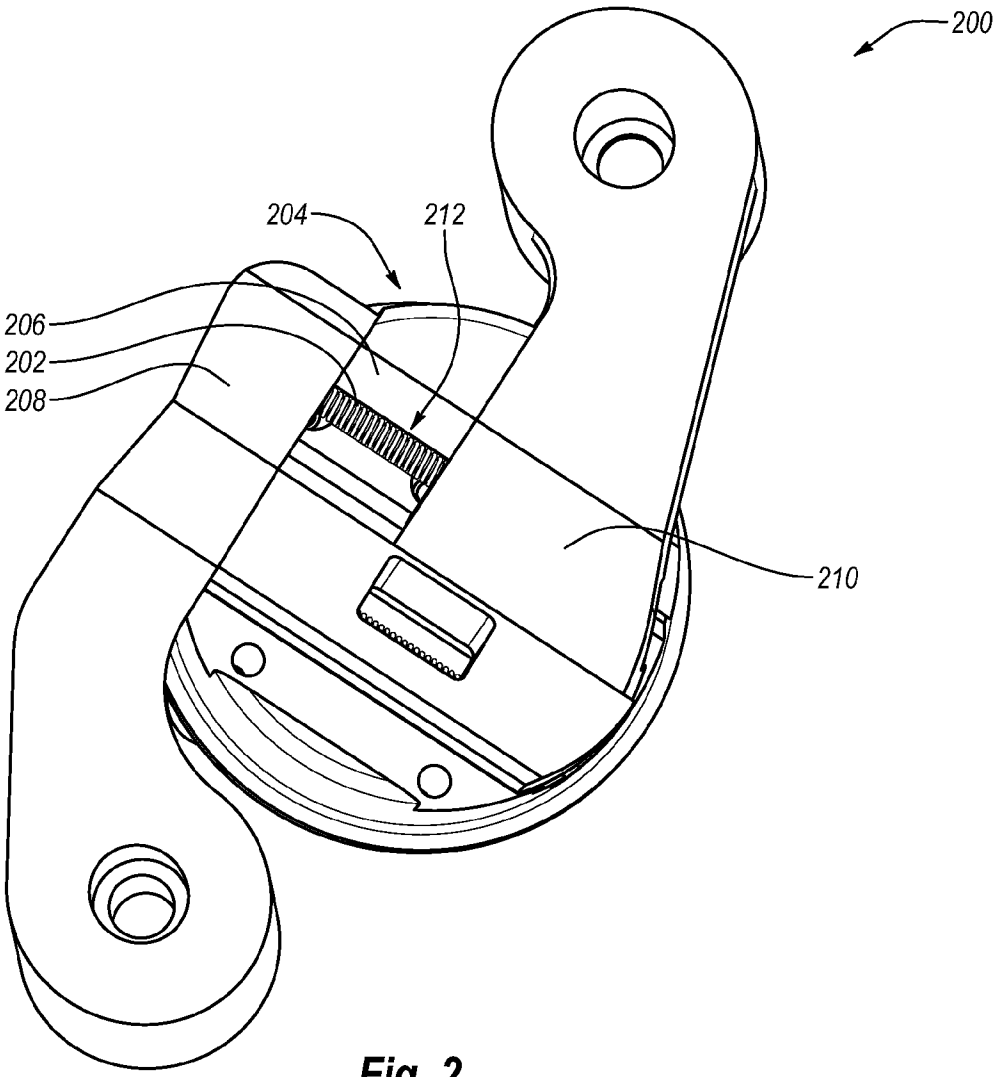
FIG. 2 is a perspective view of a cathode head of the example x-ray tube of FIGS. 1A and 1B.
Figure 3:
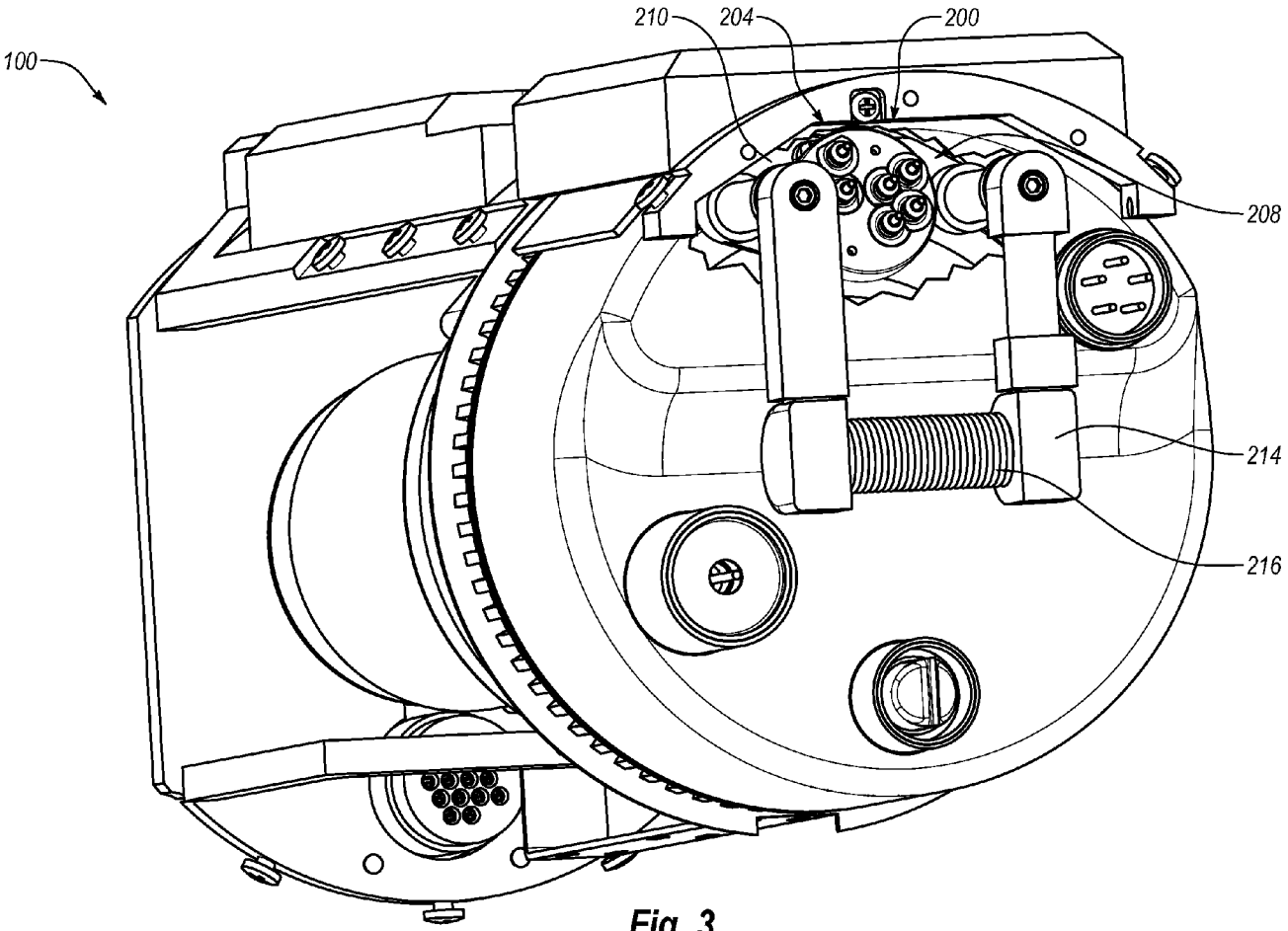
FIG. 3 is a partial cut-away view of a portion of the example x-ray tube of FIGS. 1A, 1B, and 2.
Figure 4:
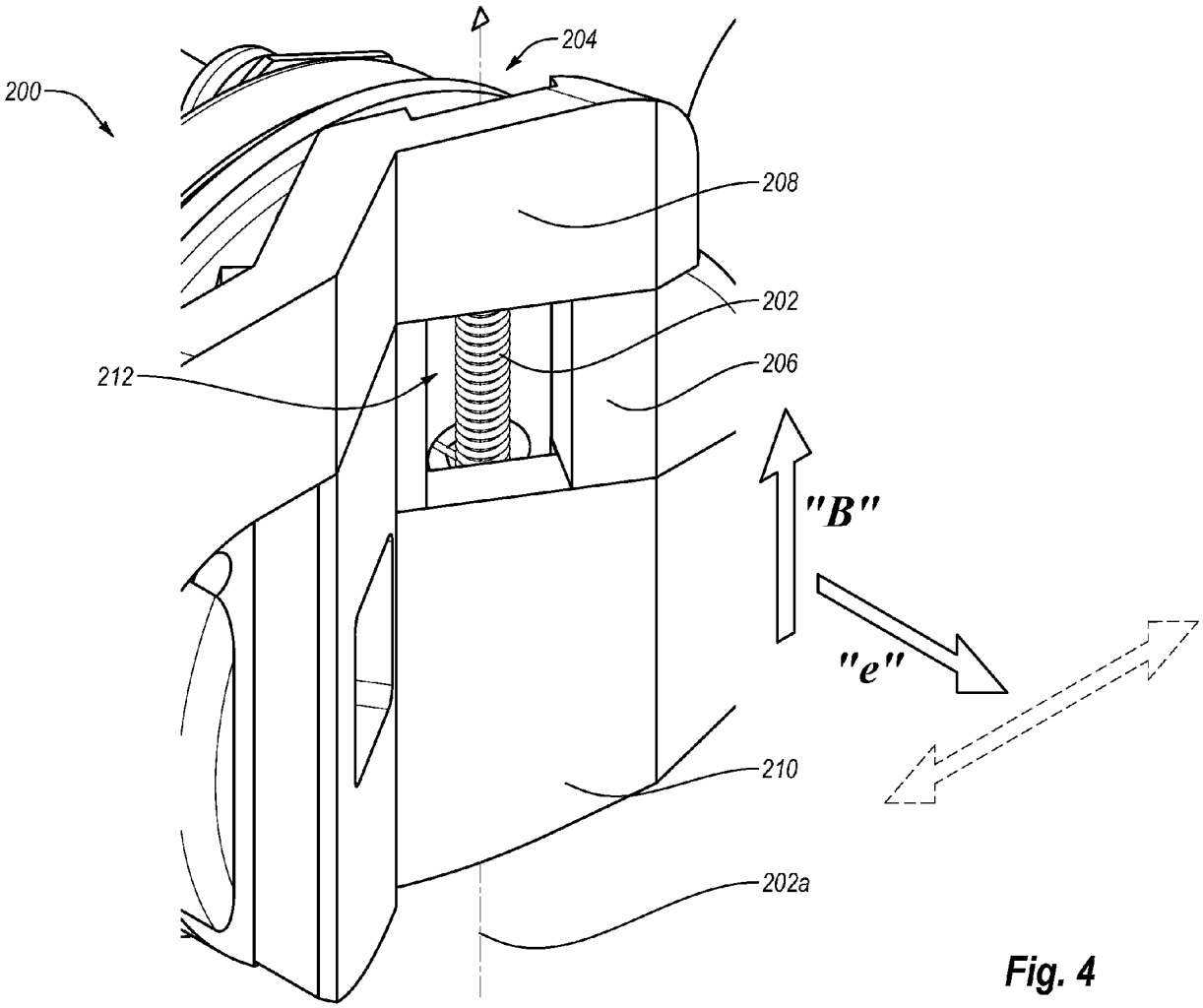
FIG. 4 is another perspective view of a portion of the cathode-head of FIG. 2.

With continued reference to FIGS. 1A and 1B, and with reference also to FIGS. 2-4, additional aspects of the example cathode 200 are disclosed. As disclosed in FIG. 2, the example cathode 200 includes a cathode head 204 including a portion of electrically conductive and non-magnetic material 206 surrounded by first and second portions of magnetic material 208 and 210. The magnetic material disclosed herein may be iron, a nickel-cobalt ferrous alloy, nickel, or a ferrite, or some combination thereof, for example. The cathode head 204 defines an emitter slot 212 in the portion of electrically conductive and non-magnetic material 206 that is positioned between the two portions of magnetic material 208 and 210. The electron emitter 202, mentioned previously, is positioned within the emitter slot 212.

As disclosed in FIG. 3, the example cathode 200 also includes a magnetic yoke which includes a core and a coil 216. The core includes a base 214 and the two portions of magnetic material 208 and 210. The base 214 is formed from a magnetic material that is coupled to the two portions of magnetic material 208 and 210. The coil 216 is wound around the base 214 of the core. The base 214 and the coil 216 are positioned outside the evacuated enclosure 206 while the cathode head 204 and the two portions of magnetic material 208 and 210 are positioned inside the evacuated enclosure 206 (see FIG. 1B). In some example embodiment, the placement of the base 214 and the coil 216 outside the evacuated enclosure 206 enables the inclusion of the magnetic yoke despite limited space within the evacuated enclosure 206.

During operation of the example x-ray tube 100, an electric current may be intermittently passed through the coil 216 (wire or tap wound). When the electric current is passed through the coil 216, the two portions of magnetic material 208 and 210 function as ends of the core and magnetic poles. For example, the coil 202 may be configured to have a magnetomotive force of about 200 ampere-turns. As disclosed in FIG. 4, when functioning as magnetic poles, the two portions of magnetic material 208 and 210 are configured to create a uniform magnetic field of magnetic flux density "B" in the emitter slot 212, as a consequence of the specific arrangement of the two portions of magnetic material 208 and 210 with respect to each other and with respect to a longitudinal axis 202*a* defined by the electron emitter 202. The magnetic field may be completely contained within the x-ray tube 100. The magnetic field may also be completely confined between the magnetic poles. The uniform magnetic field may have a flux density between about 240 gauss and about 450 gauss, for example.

The establishment of the uniform magnetic field of magnetic flux density "B", considered in connection with the direction of travel of the beam of electrons "e" emitted by the electron emitter 202, results in the ability, through the control of the uniform magnetic field, to deflect the beam of electrons "e" laterally, as indicated by the dashed arrow. Moreover, varying the electric current that is passed through the coil 216 enables reliable control over the extent to which the beam of electrons "e" is laterally deflected.

The positions of the two portions of magnetic material 208 and 210 are such that the uniform magnetic field immerses the electron emitter 202 and is configured to steer the trajectory of the beam of electrons "e" produced by the electron emitter 202 during beam formation. Thus, the beam of electrons "e" is simultaneously formed and steered, instead of being steered after formation. For example, the example cathode 200 may be configured such that the trajectory of the beam of electrons "e" is deflected during formation by the uniform magnetic field created by the magnetic poles to achieve up to about 5 mm of beam steering. At the same time, the electrically conductive and non-magnetic material 206 is configured to focus the beam of electrons "e".

Although the deflection of the trajectory of the beam of electrons "e" can be accomplished by passing an electric current through the coil 216, it is understood that the two portions of magnetic material 208 and 210 may be configured to deflect the trajectory of the beam of electrons "e" simply by virtue of their proximity to the electron emitter 202 without passing an electric current through the coil 216.

The intermittent steering of the beam of electrons "e" by the example cathode 200 can help maintain stationary the mean position of a focal spot in the subject's reference frame. This steering can be particularly useful in application where the example x-ray tube 100 is rotated during operation about a subject in order to produce x-ray images of the subject at various angles, with the direction of motion during rotation, using a gantry for example, being in the direction of the dashed arrow in FIG. 4. As disclosed in FIG. 4, the direction of motion is normal to both the magnetic field "B" and the beam of electrons "e". While the mean position of the focal spot would otherwise tend to shift during rotation of the example x-ray tube 100, the intermittent beam steering capability of the example cathode 100 enables the otherwise shifting mean position of the focal spot to remain stationary. The stationary mean position of the focal spot can result in more consistent imaging of the subject.

The example embodiments disclosed herein may be embodied in other specific forms. The example embodiments disclosed herein are therefore to be considered in all respects only as illustrative and not restrictive.

What is claimed is:

1. An x-ray tube cathode comprising:

an evacuated enclosure;

a magnetic yoke extending between a first portion inside and open to the interior of the evacuated enclosure, and a second portion outside of the evacuated enclosure;

a cathode head comprising electrically conductive and non-magnetic material integrated with a first magnetic material portion and a second magnetic material portion, the cathode head defining an emitter slot in a portion of the electrically conductive and non-magnetic material positioned between the first magnetic material portion and the second magnetic material portion, the first magnetic material portion and the second magnetic material portion coupled to the second portion of the magnetic yoke outside of the evacuated enclosure via the first portion of the magnetic yoke inside and open to the interior of the evacuated enclosure; and an electron emitter positioned within the emitter slot, the electron emitter configured to emit a beam of electrons, the beam of electrons configured to be both focused by the electrically conductive and non-magnetic material and steered during beam formation by the first magnetic material portion and the second magnetic material portion.

2. The x-ray tube cathode as recited in claim 1, wherein the cathode is configured to operate between about 25 kV and about 50 kV or at about 31 kV.

3. The x-ray tube cathode as recited in claim 1, wherein the first portion of the magnetic yoke extends in a first direction between the evacuated enclosure and the first and the second magnetic material portions, and the first and the second magnetic material portions extend from the first portion of the magnetic yoke in a second direction transverse to the first direction.

4. The x-ray tube cathode as recited in claim 1, wherein the cathode is configured such that the trajectory of the beam of electrons can be deflected by the first and second magnetic material portions to achieve up to about 5 mm of beam steering.

5. The x-ray tube cathode as recited in claim 1, wherein the first and second magnetic material portions comprise iron, a nickel-cobalt ferrous alloy, nickel, or a ferrite, or some combination thereof.

6. The x-ray tube cathode as recited in claim 1, wherein the first and second magnetic material portions are configured to create a uniform magnetic field in the emitter slot with a flux density between about 240 gauss and about 450 gauss.

7. An x-ray tube cathode comprising:

a magnetic yoke comprising a core and a coil, the core having a base and two ends formed from a magnetic material, the coil being wound around the base of the core, the two ends configured to function as magnetic poles when an electric current is passed through the coil, the two ends positioned within and open to an evacuated enclosure and the coil and the base positioned outside the evacuated enclosure;

a cathode head comprising electrically conductive and non-magnetic material integrated with the two ends of the magnetic yoke positioned on opposite sides of the electrically conductive and non-magnetic material, the two ends of the magnetic yoke mechanically coupling the cathode head to the base of the magnetic yoke positioned outside the evacuated enclosure, the cathode head defining an emitter slot positioned between the two ends; and an electron emitter positioned within the emitter slot, the electron emitter configured to emit a beam of electrons, the beam of electrons configured to be both focused by the electrically conductive and non-magnetic material and steered during beam formation by the magnetic poles.

8. The x-ray tube cathode as recited in claim 7, wherein the cathode is configured to operate between about 25 kV and about 50 kV.

9. The x-ray tube cathode as recited in claim 7, wherein the cathode is configured such that the trajectory of the beam of electrons can be deflected by the magnetic poles to achieve up to about 5 mm of beam steering.

10. The x-ray tube cathode as recited in claim 7, wherein the magnetic material comprises iron, a nickel-cobalt ferrous alloy, nickel, or a ferrite, or some combination thereof.

11. The x-ray tube cathode as recited in claim 7, wherein the magnetic poles are configured to create a uniform magnetic field in the emitter slot with a flux density between about 240 gauss and about 450 gauss.

12. An x-ray tube comprising:

an evacuated enclosure;

an anode positioned within the evacuated enclosure; and a cathode comprising:

a magnetic yoke comprising a core and a coil, the core having a base and two ends formed from a magnetic material, the coil wound around the base of the core, the coil and the base positioned outside the evacuated enclosure, the two ends positioned within the evacuated enclosure, the two ends configured to function as magnetic poles when an electric current is passed through the coil;

a cathode head comprising electrically conductive and non-magnetic material integrated with the magnetic material positioned against and coupled to the two ends of the magnetic yoke to couple the magnetic material to the base positioned outside the evacuated enclosure, the cathode head defining an emitter slot in the electrically conductive and non-magnetic material positioned between the magnetic material and the two ends; and an electron emitter positioned within the emitter slot, the electron emitter configured to emit a beam of electrons, the electron emitter immersed in a uniform magnetic field created by the magnetic yoke that is configured to steer the beam of electrons during beam formation.

13. The x-ray tube as recited in claim 12, wherein the cathode is configured to operate at about 31 kV.

14. The x-ray tube as recited in claim 12, wherein the cathode is configured such that the trajectory of the beam of electrons can be deflected by the magnetic poles to achieve up to about 5 mm of beam steering.

15. The x-ray tube as recited in claim 12, wherein the magnetic material comprises iron, a nickel-cobalt ferrous alloy, nickel, or a ferrite, or some combination thereof.

16. The x-ray tube as recited in claim 12, wherein the magnetic material is configured to create a uniform magnetic field in the emitter slot with a flux density between about 240 gauss and about 450 gauss.

17. The x-ray tube as recited in claim 12, wherein the x-ray tube is configured to rotate on a gantry about a subject while the beam of electrons is steered by the uniform magnetic field so that a mean position of a focal spot of the beam of electrons remains stationary in a reference frame of a subject despite the motion of the x-ray tube.

18. The x-ray tube as recited in claim 12, wherein the coil is configured to have a magnetomotive force of about 200 ampere-turns.

19. The x-ray tube as recited in claim 12, wherein the emitter is a helical filament.

20. The x-ray tube as recited in claim 12, wherein the magnetic field is contained within the x-ray tube.

* * * * *